US008217868B2

(12) United States Patent
Shin et al.

(10) Patent No.: US 8,217,868 B2
(45) Date of Patent: Jul. 10, 2012

(54) DISPLAY DEVICE AND METHOD OF DRIVING THE SAME

(75) Inventors: Kyoung-Ju Shin, Hwaseong-si (KR); Chong-Chul Chai, Seoul (KR); Yoon-Goo Lee, Seongnam-si (KR); Young-Soo Yoon, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 736 days.

(21) Appl. No.: 12/355,670

(22) Filed: Jan. 16, 2009

(65) Prior Publication Data

US 2009/0284453 A1 Nov. 19, 2009

(30) Foreign Application Priority Data

May 13, 2008 (KR) ..... 10-2008-0043892

(51) Int. Cl.
*G09G 3/32* (2006.01)

(52) U.S. Cl. ..... 345/82; 345/92; 345/209; 345/210

(58) Field of Classification Search ..... None
See application file for complete search history.

(56) References Cited

U.S. PATENT DOCUMENTS

| | | | | |
|---|---|---|---|---|
| 7,116,058 | B2 | 10/2006 | Lo et al. | |
| 7,834,824 | B2 * | 11/2010 | Routley et al. | 345/77 |
| 2006/0007071 | A1 * | 1/2006 | Yamazaki et al. | 345/76 |

FOREIGN PATENT DOCUMENTS

| | | |
|---|---|---|
| JP | 2002-072923 | 3/2002 |
| JP | 2003-173154 | 6/2003 |
| JP | 2003-255897 | 9/2003 |
| JP | 2006-053539 | 2/2006 |
| JP | 2006-113564 | 4/2006 |
| JP | 2006-215296 | 8/2006 |
| JP | 2007-101798 | 4/2007 |
| KR | 2005-0115346 | 12/2005 |
| KR | 10-0642265 | 10/2006 |
| KR | 10-2007-0037147 | 4/2007 |

* cited by examiner

*Primary Examiner* — Muhammad N Edun
(74) *Attorney, Agent, or Firm* — Innovation Counsel LLP

(57) ABSTRACT

In accordance with one or more embodiments of the present disclosure, an organic light emitting device is provided. By including a current leakage unit in each pixel and slowly decreasing an amount of a current flowing to the organic light emitting element, both normal luminance and black luminance can be displayed in a frame. Thus, for example, impulsive driving can be simply performed without a separate manipulation.

22 Claims, 14 Drawing Sheets

DISPLAY DEVICE AND METHOD OF DRIVING THE SAME

CROSS-REFERENCE TO RELATED APPLICATIONS

This application claims priority to and the benefit of Korean Patent Application No. 10-2008-0043892, filed in the Korean Intellectual Property Office on May 13, 2008, the entire contents of which are incorporated herein by reference.

BACKGROUND

1. Technical Field

The present invention relates to a display device and a method of driving the same and, more particularly, to an organic light emitting device and a method of driving the same.

2. Related Art

A hole-type flat panel display, such as an organic light emitting device, displays a fixed picture for a predetermined time period, for example, for a frame, regardless of a still picture or a motion picture. As an example, when some continuously moving object is displayed, the object stays at a specific position for a frame and then stays at a position to which the object is moved after a time period of a frame in a next frame, i.e., movement of the object is discretely displayed. Because a time period of a frame is a time period in which an afterimage is sustained, even if a picture is displayed in this way, it is viewed as if the object is continuously moved.

However, when a continuously moving object is viewed through a screen, a person's eye continuously moves along a motion of the object. Thereby, because movement of a person's eye collides with a discrete display method of the display device, a blurring phenomenon of a screen occurs. For example, when it is assumed that the display device displays as an object stays at a position A in a first frame and at a position B in a second frame, in the first frame, a person's eye moves along an estimated movement path of the object from the position A to the position B. However, the object is not displayed at an intermediate position but is displayed at the position A and the position B.

Therefore, because luminance that is recognized by a person for the first frame is a value, i.e., an average value, of luminance of the object and luminance of a background that is obtained by integrating luminance of pixels in a path between the position A and the position B, the object is seen as being blurred.

In a hole-type display device, because a degree to which the object is seen to be blurred is proportional to a time period in which the display device sustains the display of the object, a so-called impulsive driving method of displaying an image for only some time period within a frame and displaying a black color for the remaining time period has been suggested. In this method, because a display time period of an image decreases, luminance decreases. Accordingly, a method of increasing luminance for a display time period or a method of displaying intermediate luminance using adjacent frames instead of a black color has been suggested. However, the method increases power consumption and causes complicated driving.

The above information disclosed in this Background section is only for enhancement of understanding of the background of the present disclosure and therefore it may contain information that does not form the prior art that is already known in this country to a person of ordinary skill in the art.

SUMMARY

The present disclosure has been made in an effort to provide an organic light emitting device and a method of driving the same having, for example, advantages of simply embodying an impulsive driving method. For this purpose, in an exemplary embodiment of the present disclosure, a current leakage unit is formed within each pixel.

An exemplary embodiment of the present disclosure provides a display device including: a light-emitting device; a driving transistor that is connected to a driving voltage and that supplies a current to the light-emitting device; a switching transistor that is connected to the driving transistor and that selectively transfers a data voltage; and a current leakage unit that decreases an amount of a current that is supplied to the light-emitting device through the driving transistor.

In accordance with one or more embodiments of the present disclosure, the current leakage unit may sustain to decrease an amount of a current that is supplied to the light-emitting device within one frame. The light-emitting device may display black luminance while displaying normal luminance within the one frame. Each of the driving transistor and the switching transistor may include a control terminal, an input terminal, and an output terminal, a contact point exists between the control terminal of the driving transistor and the output terminal of the switching transistor, and the current leakage unit may be connected through the contact point.

In accordance with one or more embodiments of the present disclosure, the current leakage unit may include a leakage transistor having a control terminal, an input terminal, and an output terminal, the input terminal of the leakage transistor may be connected to the contact point, and the control terminal of the leakage transistor may be connected to the input terminal thereof. One end of the light-emitting device may be connected to the output terminal of the driving transistor, the other end thereof may be connected to a common voltage terminal, and the output terminal of the leakage transistor may be connected to the common voltage terminal. The control terminal of the switching transistor may be connected to a scanning signal line, and the output terminal of the leakage transistor may be connected to the scanning signal line. The control terminal of the switching transistor may be connected to a first scanning signal line, and the output terminal of the leakage transistor may be connected to a second scanning signal line. The output terminal of the leakage transistor may be connected to a bias voltage. The bias voltage may have at least a first voltage level and a second voltage level, if the first voltage level is applied to the bias voltage a current may not be leaked through the current leakage unit, and if the second voltage level is applied to the bias voltage a current may be leaked through the current leakage unit.

In accordance with one or more embodiments of the present disclosure, the current leakage unit may include a leakage transistor having a control terminal, an input terminal, and an output terminal, the input terminal of the leakage transistor may be connected to the contact point, and the control terminal of the leakage transistor may be connected to the output terminal thereof. The current leakage unit may include a leakage transistor having a control terminal, an input terminal, and an output terminal, the input terminal of the leakage transistor may be connected to the contact point, and the control terminal of the leakage transistor may be connected to a first bias voltage. One end of the light-emitting device may be connected to the output terminal of the driving transistor, the other end thereof may be connected to a common voltage terminal, and the output terminal of the leakage transistor may be connected to the common voltage terminal. The control terminal of the switching transistor may be connected to a scanning signal line, and the output terminal of the leakage transistor may be connected to the scanning signal line. The control terminal of the switching transistor may be connected to a first scanning signal line, and the output terminal of the leakage transistor may be connected to a second scanning signal line. The output terminal of the leakage transistor may be connected to a first bias voltage. The output terminal of the leakage transistor may be connected to a second bias voltage.

In accordance with one or more embodiments of the present disclosure, the second bias voltage may have at least a first voltage level and a second voltage level, if the first voltage level is applied to the bias voltage a current may not be leaked through the current leakage unit, and if the second voltage level is applied to the bias voltage a current may be leaked through the current leakage unit. The first bias voltage may be applied from a scanning signal line that is different from a scanning signal line to which the switching transistor is connected. The display device may further include a capacitor that is connected between the input terminal of the driving transistor and the contact point.

Another embodiment of the present disclosure provides a method of driving a display device including a plurality of pixels having a light-emitting device, a driving transistor that supplies a current to the light-emitting device, and a current leakage unit, including: allowing the light-emitting device to emit light by applying a data signal to the driving transistor; and decreasing an amount of a current flowing to the light-emitting device through the current leakage unit. The decreasing of an amount of a current flowing to the light-emitting device through the current leakage unit may include selectively performing one of decreasing an amount of a current flowing to the light-emitting device by applying a first voltage to the current leakage unit, and not decreasing an amount of a current flowing to the light-emitting device by applying a second voltage to the current leakage unit. The pixel may display black after a predetermined time period has elapsed as an amount of a current flowing to the light-emitting device decreases.

By connecting the current leakage unit to the inside of each pixel, an amount of a current flowing to the organic light emitting element slowly decreases. Accordingly, both normal brightness and black brightness can be displayed within a frame and thus impulsive driving can be performed. Therefore, impulsive driving can be simply performed without separate manipulation. In one aspect, a time period for reaching black luminance can be adjusted by adjusting characteristics of the current leakage unit, and an impulsive mode may not be operated by adjusting a voltage that is applied to the current leakage unit.

DETAILED DESCRIPTION

The present disclosure will be described more fully hereinafter with reference to the accompanying drawings, in which exemplary embodiments of the present disclosure are shown. As those skilled in the art would realize, the described embodiments may be modified in various different ways, all without departing from the spirit or scope of the present disclosure.

Figure 1:
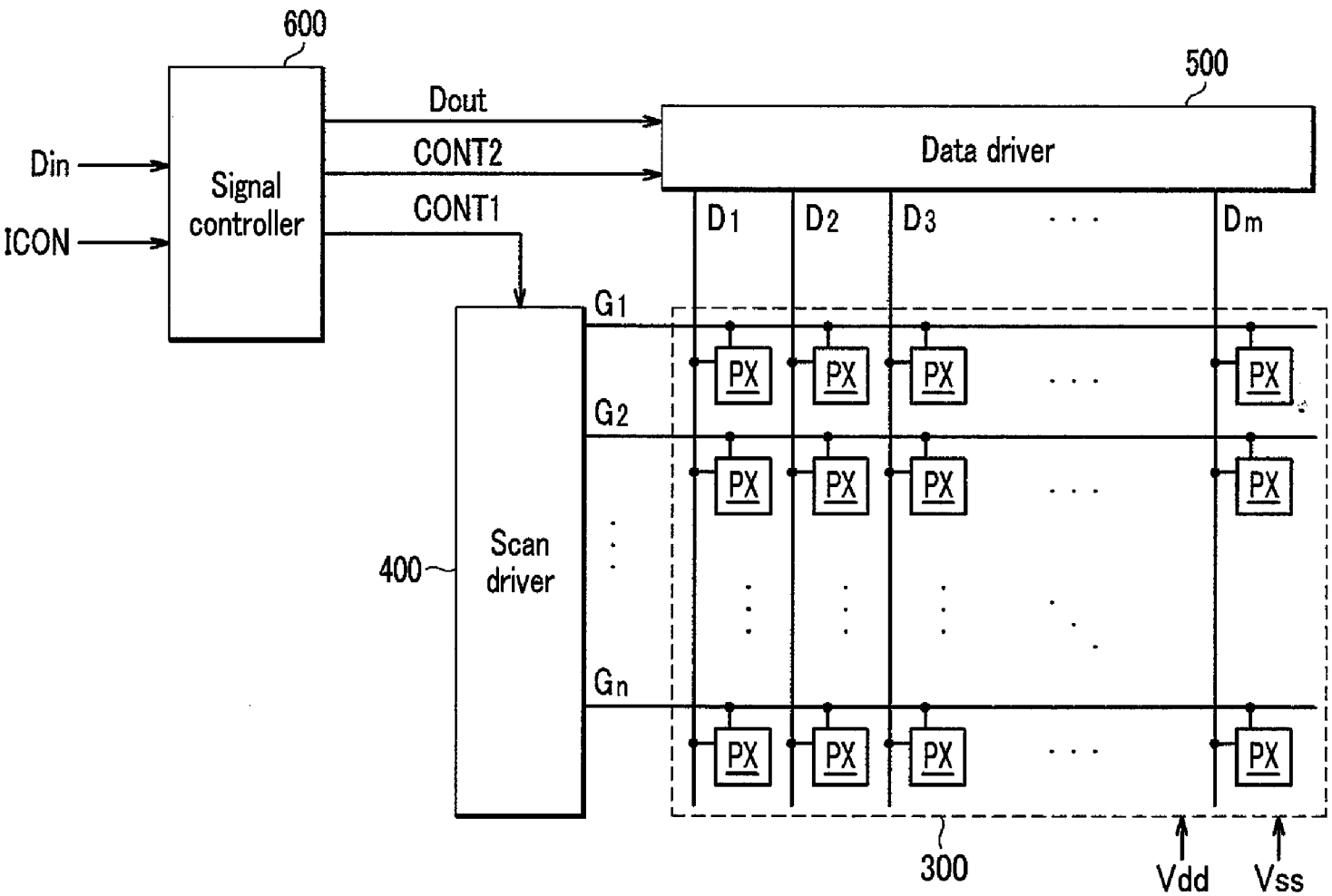
FIG. 1 is a block diagram of an organic light emitting device according to an exemplary embodiment of the present disclosure.

An organic light emitting device according to an exemplary embodiment of the present disclosure will be described with reference to FIGS. 1 and 2. FIG. 1 is a block diagram of an organic light emitting device according to an exemplary embodiment of the present disclosure, and FIG. 2 is an equivalent circuit diagram of a pixel in the organic light emitting device according to an exemplary embodiment of the present disclosure.

Referring to FIG. 1, the organic light emitting device includes a display panel 300, a scan driver 400, a data driver 500, and a signal controller 600. The display panel 300 includes a plurality of signal lines G1-Gn and D1-Dm, a plurality of voltage lines (not shown), and a plurality of pixels PX that are connected thereto and arranged in approximately a matrix form.

The signal lines G1-Gn and D1-Dm include a plurality of scanning signal lines G1-Gn that transfer a scanning signal and a plurality of data lines D1-Dm that transfer a data signal. The scanning signal lines G1-Gn are extended in approximately a row direction and are almost parallel to each other, and the data lines D1-Dm are extended in approximately a column direction and are almost parallel to each other. Each voltage line (not shown) transfers a driving voltage Vdd and a common voltage Vss.

Figure 2:
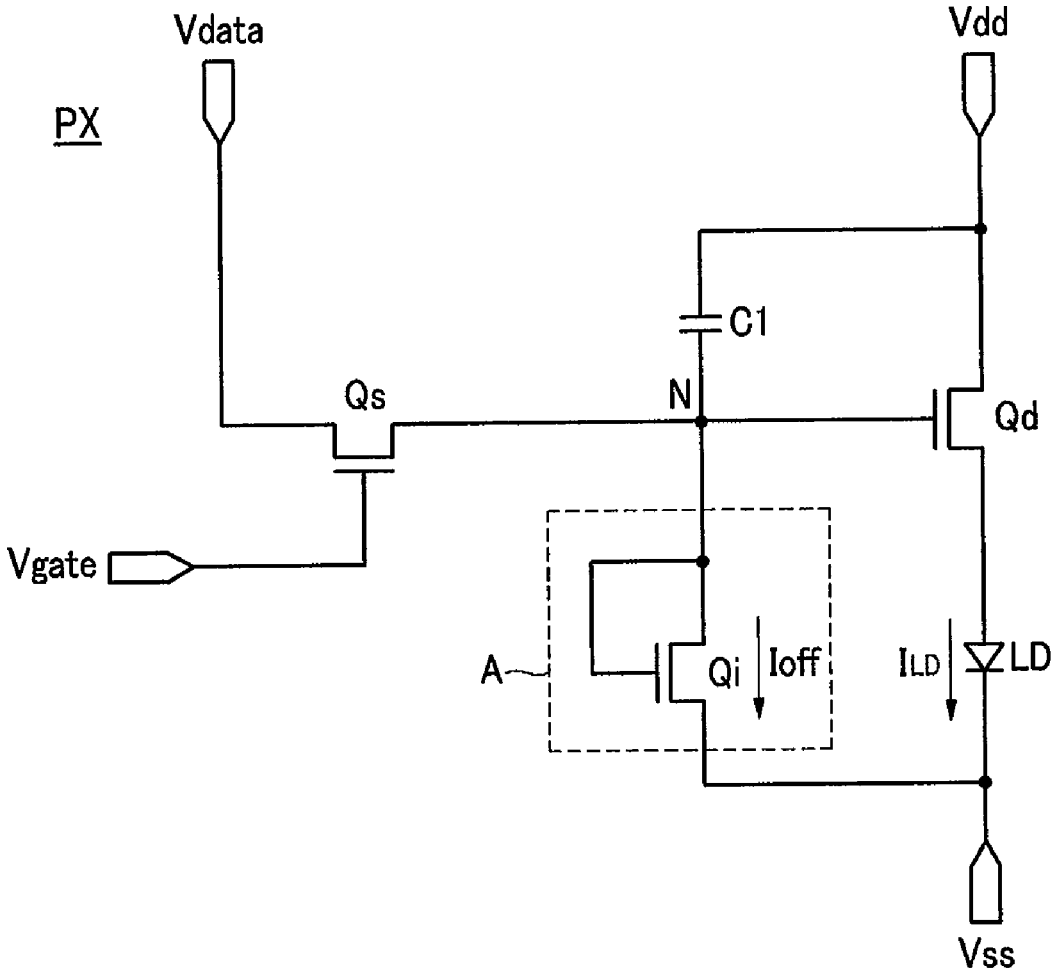
FIG. 2 is an equivalent circuit diagram of a pixel in the organic light emitting device according to an exemplary embodiment of the present disclosure.

In one embodiment, as shown in FIG. 2, each pixel PX includes an organic light emitting element LD, a driving transistor Qd, a capacitor C1, a switching transistor Qs, and a current leakage unit A. The driving transistor Qd comprises an output terminal, an input terminal, and a control terminal. The control terminal of the driving transistor Qd is connected to a contact point N, the input terminal thereof is connected to a driving voltage Vdd terminal, and the output terminal thereof is connected to one end of the organic light emitting element LD. One end of the capacitor C1 is connected to the contact point N, and the other end thereof is connected to the driving voltage Vdd terminal. In one aspect, the capacitor C1 is connected between the control terminal and the input terminal of the driving transistor Qd to provide charges corresponding to a difference between a data voltage Vdata and the driving voltage Vdd that are supplied through the switching transistor Qs.

The switching transistor Qs comprises an output terminal, an input terminal, and a control terminal. The control terminal of the switching transistor Qs is connected to the scanning signal lines G1-Gn to receive a gate voltage Vgate, the input terminal thereof is connected to the data lines D1-Dm to receive the data voltage Vdata, and the output terminal thereof is connected to the contact point N. Here, the gate voltage Vgate includes a gate-on voltage Von and a gate-off voltage Voff, the gate-on voltage Von turns on the switching transistor Qs, and the gate-off voltage Voff turns off the switching transistor Qs.

In one implementation, the switching transistor Qs is turned on by a gate-on voltage Von that is supplied through the scanning signal lines G1-Gn and transfers the data voltage Vdata to the control terminal of the driving transistor Qd via the contact point N. In another embodiment, the switching transistor Qs and the driving transistor Qd include an n-channel metal oxide semiconductor field effect transistor (MOSFET) consisting of amorphous silicon or poly-silicon. However, the transistors Qs and Qd may include a p-channel MOSFET, and in this case, because the p-channel MOSFET and the n-channel MOSFET are complementary, an operation, a voltage, and a current of the p-channel MOSFET are opposite to those of the n-channel MOSFET.

The organic light emitting element LD comprises a light emitting diode (LED) having an emission layer, and has an anode and a cathode. The anode is connected to the output terminal of the driving transistor Qd, and the cathode is connected to the common voltage Vss terminal. The organic light emitting element LD displays an image by emitting light with different intensity according to a magnitude of a current ILD that is supplied by the driving transistor Qd, and the magnitude of the current ILD depends on the magnitude of a voltage between the control terminal and the input terminal of the driving transistor Qd.

Moreover, a current leakage unit A is formed in a pixel according to an exemplary embodiment of the present disclosure. The current leakage unit A is connected between the contact point N and the common voltage Vss terminal. The current leakage unit A includes a leakage transistor Qi. The leakage transistor Qi has a control terminal, an input terminal, and an output terminal, and the control terminal and the input terminal thereof are connected to the contact point N. Further, the output terminal thereof is connected to the common voltage Vss terminal.

Figure 3:
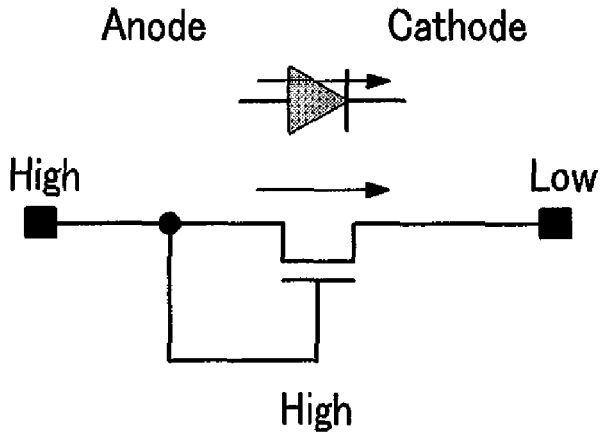
FIGS. 3 and 4 are diagrams illustrating an operation of a transistor whose control terminal is connected to an input terminal thereof.
Figure 4:
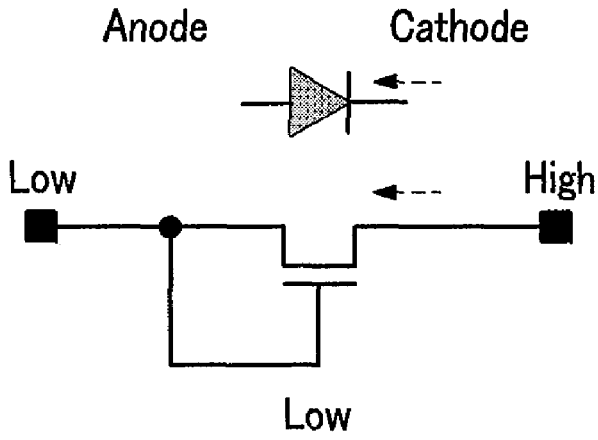

FIGS. 3 and 4 are diagrams illustrating an operation of a transistor whose control terminal is connected to an input terminal thereof. In particular, FIG. 3 illustrates a case where a high voltage is applied to an input terminal side of the transistor and a low voltage is applied to an output terminal side thereof, and FIG. 4 illustrates a case where a low voltage is applied to the input terminal side of the transistor and a high voltage is applied to the output terminal side thereof.

Referring to FIG. 3, if a high voltage is applied to the input terminal side, a high voltage is also applied to the control terminal that is connected thereto. Accordingly, the transistor is turned on, and thus a current flows from the input terminal side having a high voltage to the output terminal side having a low voltage.

Referring to FIG. 4, if a low voltage is applied to the input terminal side, a low voltage is applied to the control terminal thereof. Accordingly, the transistor is turned off and sustains a state wherein a current does not flow. Therefore, even if a voltage difference exists between the input terminal and the output terminal thereof, a current does not flow through the transistor. The operation of the transistor is similar to that of the diode. That is, only when a voltage of the input terminal is high does a current flows, and when a voltage of the output terminal is high, a current does not flow. Such a connection of the transistor is called a diode connection.

In one embodiment, referring again to FIG. 1, the scan driver 400 is connected to the scanning signal lines G1-Gn of the display panel 300, and a gate voltage Vgate consisting of a combination of a gate-on voltage Von and a gate-off voltage Voff is applied to the scanning signal lines G1-Gn. The data driver 500 is connected to the data lines D1-Dm of the display panel 300 and applies a data voltage Vdata for displaying an image signal to the data lines D1-Dm. The signal controller 600 controls an operation of the scan driver 400, the data driver 500, etc.

Each of the driving devices 400, 500, and 600 may be directly mounted on the display panel 300 in at least one IC chip form, may be mounted on a flexible printed circuit film (not shown) to be attached to the display panel 300 in a tape carrier package (TCP) form, or may be mounted on a separate printed circuit board (PCB) (not shown). Alternatively, the driving devices 400, 500, and 600 together with the signal lines G1-Gn and D1-Dm and the transistors Qs, Qd, and Qi may be integrated with the display panel 300.

Figure 5:
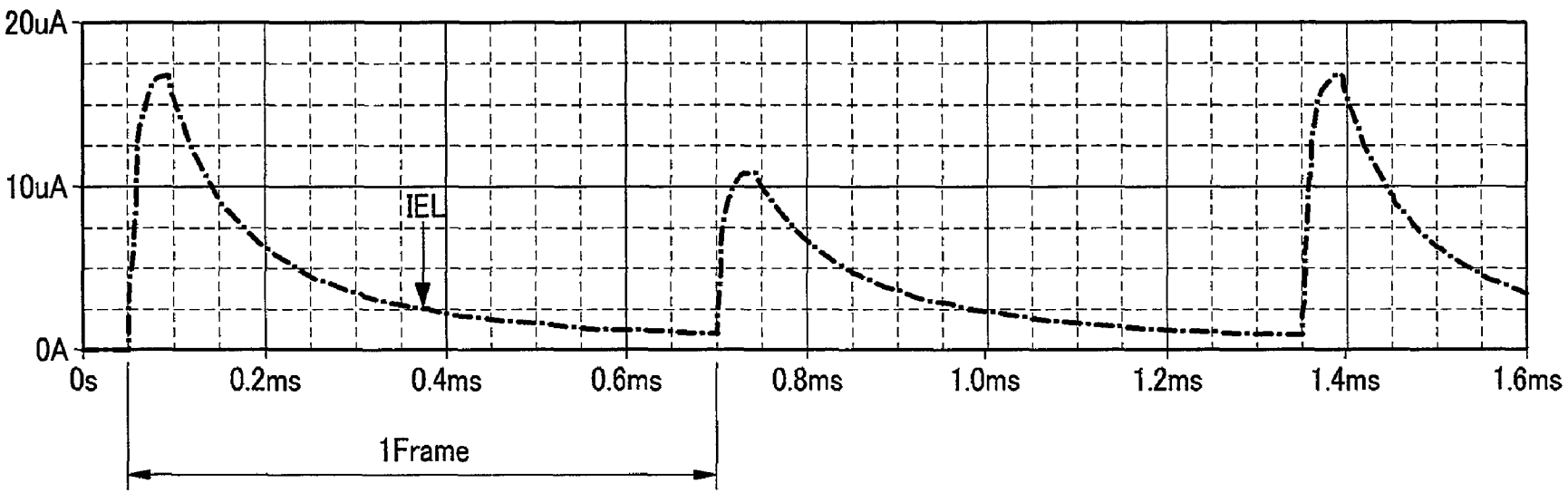
FIG. 5 illustrates an example of a waveform diagram sequentially illustrating a current flowing to an organic light emitting element in the organic light emitting device according to an exemplary embodiment of the present disclosure.

A display operation of the organic light emitting device is described in detail with reference to FIGS. 1, 2, 5, and 6. In particular, FIG. 5 illustrates an example of a waveform diagram sequentially illustrating a current flowing to an organic light emitting element in the organic light emitting device according to an exemplary embodiment of the present disclosure, and FIG. 6 illustrates an example of a waveform diagram sequentially illustrating each voltage in the organic light emitting device according to an exemplary embodiment of the present disclosure.

The signal controller 600 receives an input image signal Din and an input control signal ICON for controlling the display of the input image signal Din from an external graphics controller (not shown). The input image signal Din includes luminance information of each pixel PX, and luminance thereof has grays of a given quantity, for example 1024=210, 256=28, or 64=26. The input control signal ICON includes, for example, a vertical synchronization signal, a horizontal synchronizing signal, a main clock signal, and a data enable signal.

The signal controller 600 appropriately processes the input image signal Din to correspond to an operating condition of the display panel 300 based on the input image signal Din and the input control signal ICON, and generates a scanning control signal CONT1 and a data control signal CONT2. The signal controller 600 sends the scanning control signal CONT1 to the scanning driver 400, and sends the data control signal CONT2 and an output image signal Dout to the data driver 500.

Figure 6:
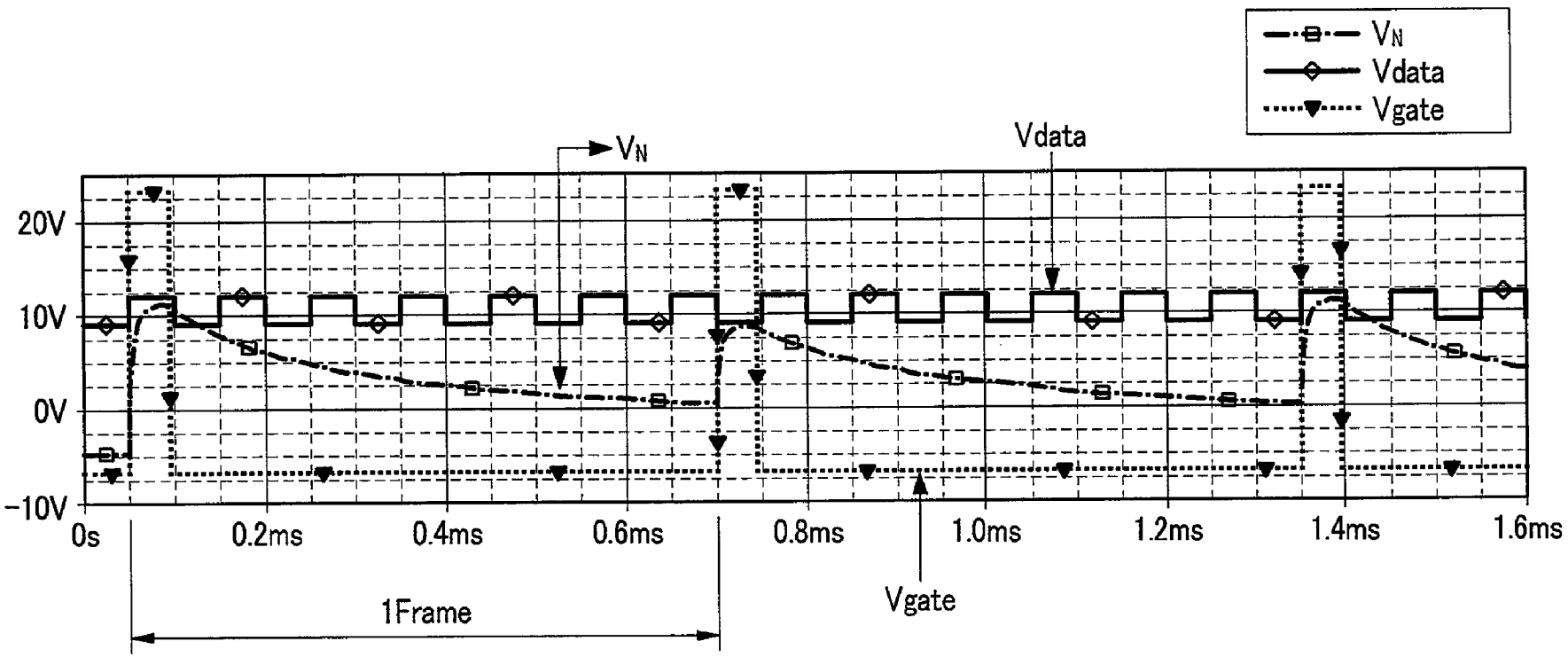
FIG. 6 illustrates an example of a waveform diagram sequentially illustrating each voltage in an organic light emitting device according to an exemplary embodiment of the present disclosure.

In one embodiment, referring to FIG. 6, the scan driver 400 changes a scanning signal that is applied to the scanning signal lines G1-Gn according to the scan control signal CONT1 from the signal controller 600 to the gate-on voltage Von.

If a scanning signal of the gate-on voltage Von is supplied from the scan driver 400, the switching transistor Qs is turned on, and a data voltage Vdata is injected to the contact point N through the switching transistor Qs and is applied to the control terminal of the driving transistor Qd via the contact point N. The driving transistor Qd receives the data voltage Vdata and outputs a current ILD according to a magnitude of a voltage between the control terminal and the input terminal of the driving transistor Qd. The output current ILD flows to the organic light emitting element LD, and the organic light emitting element LD emits light corresponding to the supplied current ILD.

As shown in FIGS. 5 and 6, if a high voltage is applied to the scanning signal, the data voltage Vdata is applied to the contact point N through the switching transistor Qs and thus a voltage VN of the contact point N rapidly rises. Further, as a voltage (equal to a voltage VN of the contact point N) of the control terminal of the driving transistor Qd rapidly rises, an amount of a current ILD that is output through the output terminal also rapidly rises.

In one embodiment, the current leakage unit A compares the voltage VN of the contact point N with the common voltage Vss, and if the voltage VN of the contact point N is higher than the common voltage Vss, the current leakage unit A allows the leakage current Ioff to flow to the common voltage Vss terminal. As the difference between the voltage VN of the contact point N and the common voltage Vss increases, an amount of the leakage current Ioff also increases. That is, because the leakage transistor Qi of the current leakage unit A has a diode connection, if the voltage VN of the contact point N is higher than the common voltage Vss, the leakage transistor Qi is turned on and thus a leakage current Ioff flows to a common voltage Vss side. Further, when the leakage transistor Qi is turned on, as the difference between the voltage VN of the contact point N and the common voltage Vss increases, a large amount of the leakage current Ioff flows.

The voltage VN of the contact point N is lowered due to the leakage current Ioff, and thus when the leakage transistor Qi is turned off, the leakage current Ioff no longer flows. Further, even if the common voltage Vss becomes higher than the voltage VN of the contact point N, the leakage transistor Qi has a diode connection, whereby a current does not flow.

In one implementation, the capacitor C1 should continue to sustain a voltage between the control terminal and the input terminal of the driving transistor Qd for a frame, however because a current is leaked through the current leakage unit A, a voltage that is stored in the capacitor C1 also slowly decreases.

As shown in FIGS. 5 and 6, if a voltage that is stored in the capacitor C1 due to the current leakage unit A decreases, an amount of a current ILD that is output through the output terminal decreases, and thus luminance of light that is emitted by the organic light emitting element LD is lowered and black luminance is finally displayed. As the current leakage unit A is formed in each pixel and black luminance is displayed while normal luminance is being displayed within a frame without a separate signal manipulation, impulsive driving can be performed. By adjusting an amount of the leakage current Ioff, a time period that is required for advancing from normal luminance to black luminance can be adjusted. This can be executed by adjusting characteristics of the leakage transistor Qi within the current leakage unit A. That is, if the leakage transistor Qi is designed to have an increased leakage current, a time period that is required for advancing from normal luminance to black luminance can be reduced and an opposite case can be also executed. The current leakage unit A may have various exemplary embodiments, and various exemplary embodiments of the current leakage unit A are described hereinafter.

Figure 7:
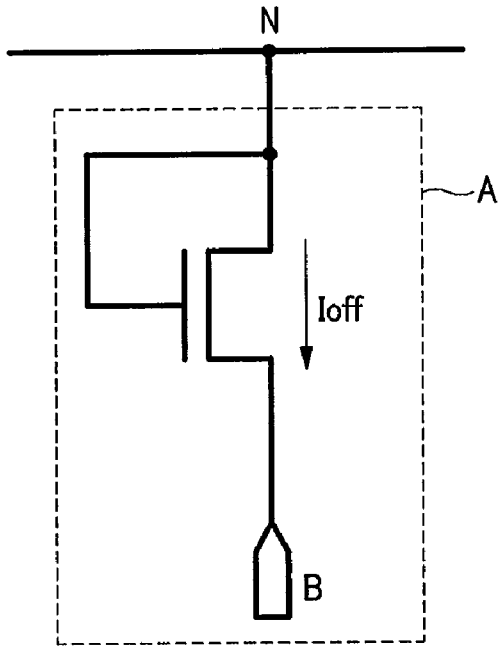
FIGS. 7 and 8 illustrate a representative structure of a current leakage unit according to an exemplary embodiment of the present disclosure.
Figure 8:
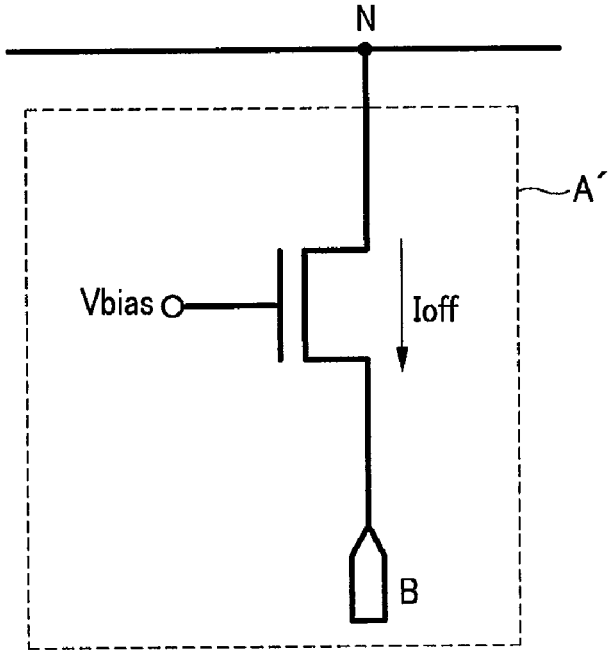

FIGS. 7 and 8 illustrate a representative structure of a current leakage unit according to an exemplary embodiment of the present disclosure. In particular, FIG. 7 illustrates a leakage transistor whose control terminal and input terminal are connected, and the control terminal and the input terminal thereof are connected to the contact point N and the output terminal thereof is connected to a terminal B. Here, the terminal B may be a common voltage Vss terminal or a scanning signal line, as in FIG. 2, and may be a separate bias line. An exemplary embodiment in which the control terminal is connected to another terminal is described in detail with reference to FIGS. 9 to 12.

In one embodiment, referring to FIG. 8, the control terminal thereof is connected to the bias line to receive a bias voltage Vbias, the input terminal thereof is connected to the contact point N, and the output terminal thereof is connected to the terminal B. Here, the terminal B may be the common voltage Vss terminal or the scanning signal line, and may be a separate bias line. This is described in detail with reference to FIGS. 13 to 16.

A current leakage unit having a leakage transistor of a diode connection is designated by A in FIGS. 2 and 7, and a current leakage unit having a leakage transistor that receives a bias voltage Vbias in the control terminal thereof is designated by A' in FIG. 8. The bias voltage Vbias that is applied to the control terminal of the leakage transistor of FIG. 8 is generally fixed to a voltage value in which the leakage transistor may be in a turn-off state. This is because the leakage current Ioff is not a current that is output to the output terminal of the leakage transistor when the leakage transistor is turned on, but is a current that is leaked due to characteristics of the leakage transistor. The leakage transistor may be in a turn-on state due to the bias voltage Vbias.

Various exemplary embodiments of the current leakage unit are described with reference to FIGS. 9 to 16. In particular, FIGS. 9 to 16 illustrate equivalent circuit diagrams of a pixel in the organic light emitting device according to an exemplary embodiment of the present disclosure. FIGS. 9 to 12 illustrate an exemplary embodiment of the current leakage unit A of FIG. 7, and FIGS. 13 to 16 illustrate an exemplary embodiment of the current leakage unit A' of FIG. 8.

Figure 9:
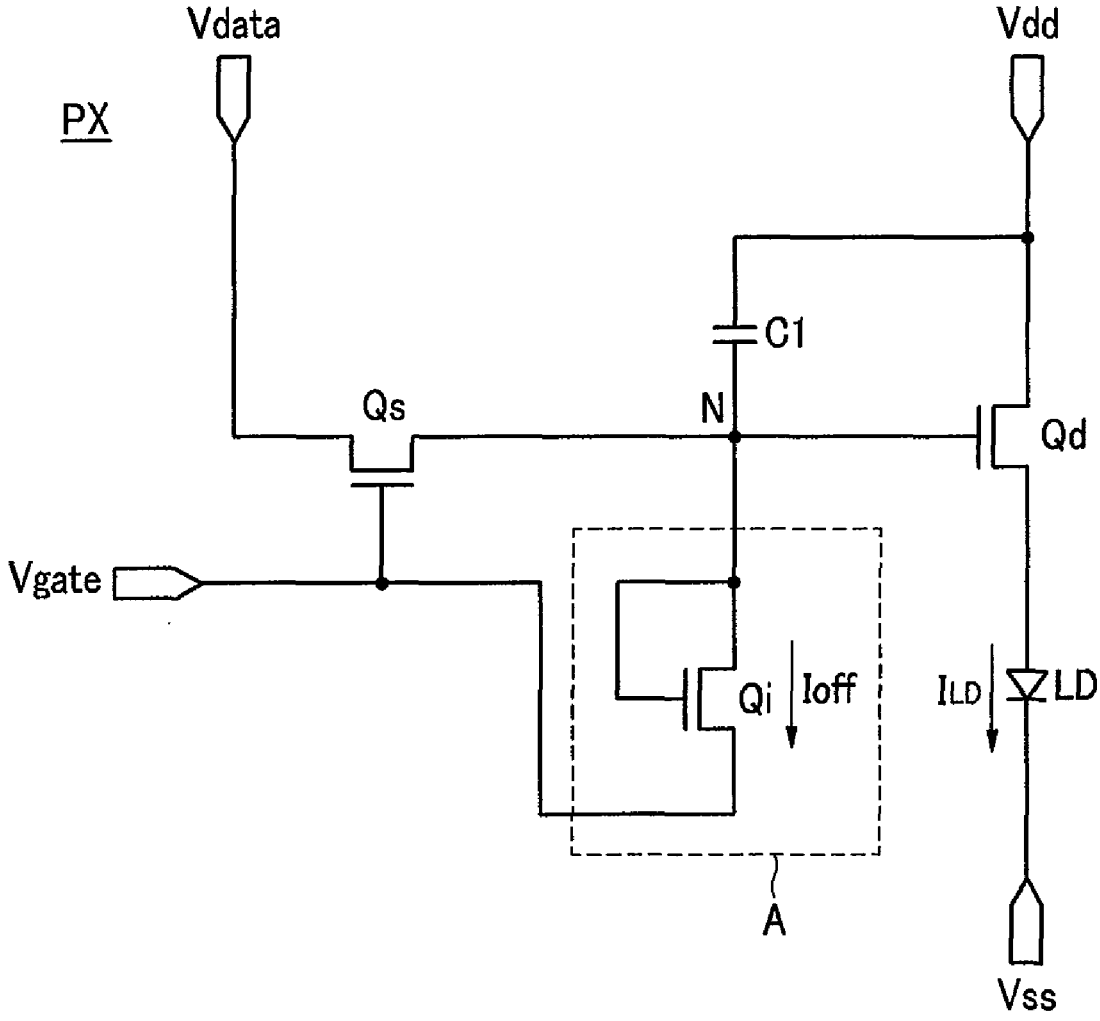
FIGS. 9 to 16 illustrate equivalent circuit diagrams of a pixel in the organic light emitting device according to an exemplary embodiment of the present disclosure.

In the structures of FIGS. 9 to 16, a driving transistor Qd, a capacitor C1, a switching transistor Qs, and an organic light emitting element LD have the same structure as those of FIG. 2, thus a detailed description thereof is omitted, and the structure thereof has a basic pixel structure of the organic light emitting device. A structure of the current leakage unit A in the pixel of FIG. 9 is described hereinafter.

The current leakage unit A is connected between the contact point N and the scanning signal line, and includes a leakage transistor Qi having a diode connection. The leakage transistor Qi has a control terminal, an input terminal, and an output terminal, and the control terminal and the input terminal thereof are coupled to be connected to the contact point N. The output terminal thereof is connected to the scanning signal line.

In this case, if a gate-on voltage Von is applied through the scanning signal line, the voltage VN of the contact point N rises, however after the gate-on voltage Von is removed, because a gate voltage Vgate of the scanning signal line is lower than the voltage VN of the contact point N, the leakage current Ioff flows, i.e., the same effect as that of FIG. 2 is obtained. The gate-on voltage Von is applied to the gate voltage Vgate, and even if the gate voltage Vgate has a voltage value higher than the voltage VN of the contact point N, the leakage transistor Qi of the current leakage unit A has a diode connection, whereby a current does not flow from the output terminal toward the input terminal. Further, a time period in which the gate-on voltage Von is applied is short enough to ignore.

Figure 10:
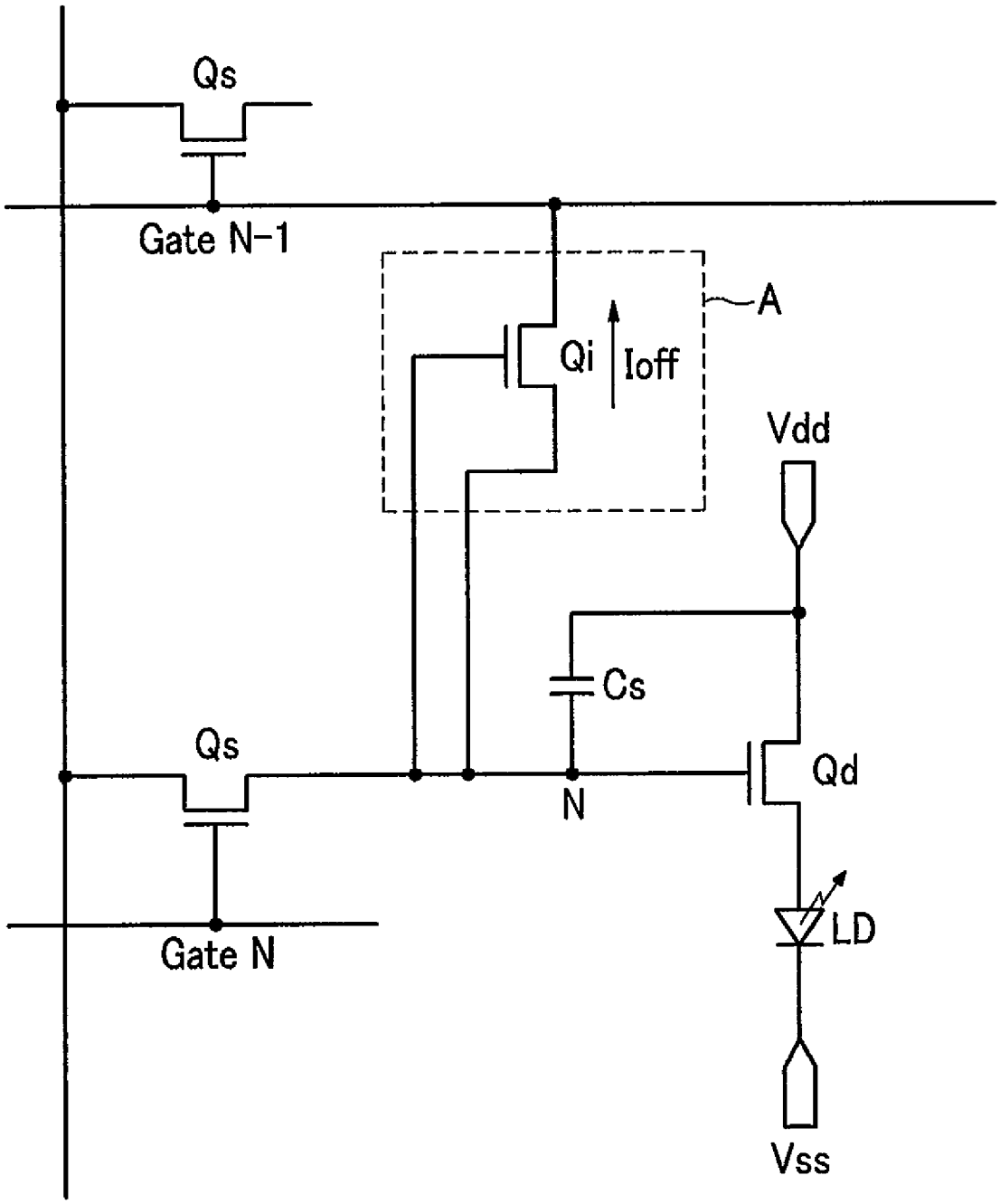

FIG. 9 illustrates a structure in which the output terminal of the leakage transistor Qi is connected to a scanning signal line of a pixel, and the output terminal of the leakage transistor Qi may be connected to a scanning signal line of another row, and this is described in FIG. 10. As such, FIG. 10 illustrates a structure of the current leakage unit A in a pixel.

In one embodiment, the current leakage unit A is connected between the contact point N and a scanning signal line (Gate N−1) of a previous row, and includes a leakage transistor Qi having a diode connection. The leakage transistor Qi has a control terminal, an input terminal, and an output terminal, and the control terminal and the input terminal thereof are coupled to be connected to the contact point N. The output terminal is connected to the scanning signal line (Gate N−1) of a previous row.

In this case, if the gate-on voltage Von is applied through the scanning signal line (Gate N−1) of a previous row, the voltage VN of the contact point N rises, and after the gate-on voltage Von is removed, because a gate voltage Vgate of the scanning signal line is lower than the voltage VN of the contact point N, a leakage current Ioff flows, i.e., the same effect as that of FIG. 2 is obtained. Because the scanning signal line (Gate N−1) of a previous row is used, even when a gate-on voltage Von is applied to a scanning signal line Gate N of a current row, a voltage of an output terminal side of the leakage transistor Qi is low and thus a gate signal is less influenced.

In one aspect, as the gate-on voltage Von is applied to the scanning signal line (Gate N−1) of a previous row, even if a voltage of an output terminal side is high, the leakage transistor Qi of the current leakage unit A has a diode connection and thus a current does not flow from the output terminal toward the input terminal.

Figure 11:
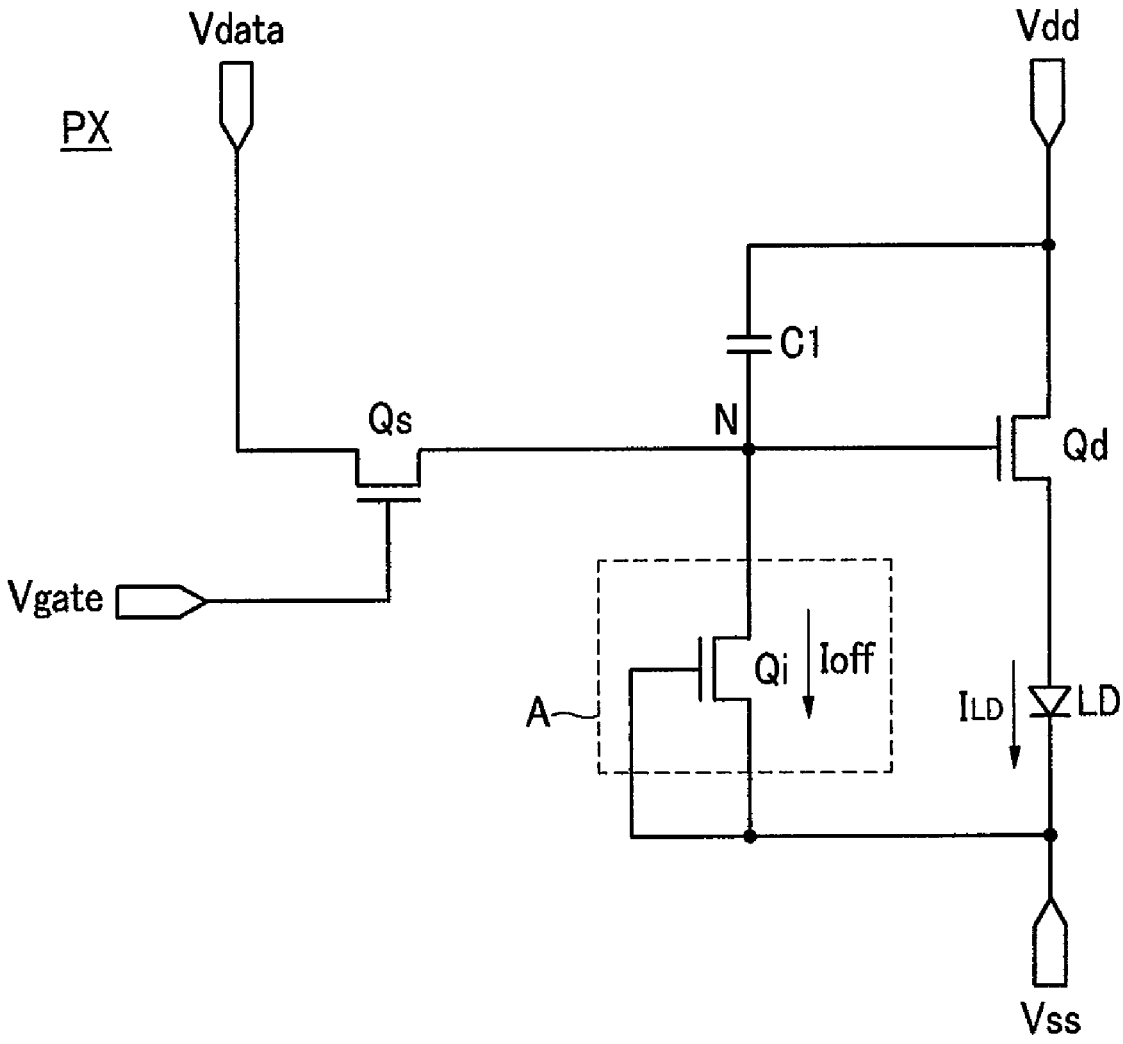

FIG. 11 illustrates a structure of the current leakage unit A in a pixel. The current leakage unit A is connected between the contact point N and the common voltage Vss terminal, and includes a leakage transistor Qi having a diode connection. Here, unlike FIG. 2, the control terminal of the leakage transistor Qi is connected to the output terminal thereof. In the present exemplary embodiment, when a common voltage Vss has a high voltage, the leakage transistor Qi is turned on and the common voltage Vss has a constantly low voltage, and thus the leakage transistor Qi is not turned on. However, when the voltage VN of the contact point N is high, even in a state where the leakage transistor Qi is turned off, the leakage transistor Qi allows a leakage current to voluntarily flow. Accordingly, even if a voltage that is charged to the capacitor C1 due to the corresponding leakage current emits, the current leakage unit A operates, as in the exemplary embodiment of FIG. 2. However, there is a merit that the present exemplary embodiment has a leakage current Ioff amount that is less than that of the exemplary embodiment of FIG. 2.

Figure 12:
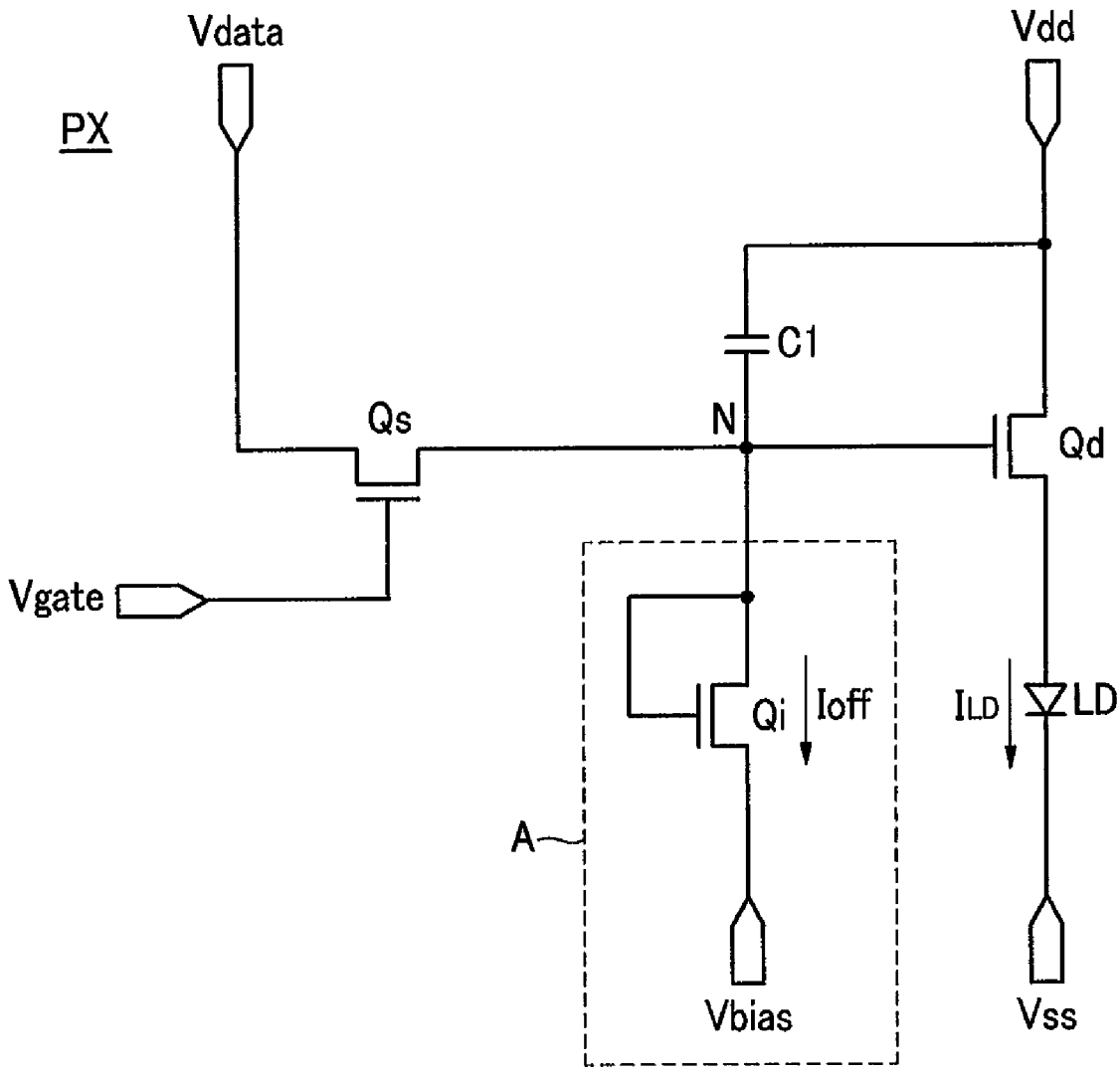

FIG. 12 illustrates a structure of the current leakage unit A according to another exemplary embodiment of the present disclosure. The current leakage unit A is connected between the contact point N and the bias voltage Vbias terminal, and includes a leakage transistor Qi having a diode connection. The leakage transistor Qi has a control terminal, an input terminal, and an output terminal, and the control terminal and the input terminal thereof are coupled to be connected to the contact point N. The output terminal thereof is connected to the bias voltage Vbias terminal. In this case, according to a magnitude of the bias voltage Vbias, various characteristics appear. If the bias voltage Vbias is lower than a voltage VN of the contact point N, a leakage current Ioff flows. Therefore, by adjusting a level of the bias voltage Vbias, an amount of the leakage current Ioff can be adjusted.

In one aspect, when the bias voltage Vbias is higher than the voltage VN of the contact point N (hereinafter referred to as a high voltage; when the bias voltage Vbias is lower than the voltage VN of the contact point N, referred to as a low voltage), a leakage current Ioff does not flow. Accordingly, because black luminance is not displayed, impulsive driving is not performed. Therefore, two voltages (a high voltage and a low voltage) are applied to the bias voltage Vbias, the high voltage has a voltage value that is much higher than a voltage VN of the contact point N, and the low voltage has a voltage value of a level that is formed by the leakage current Ioff. If a high voltage is applied to the bias voltage Vbias, a leakage current Ioff is not generated and thus light is emitted with only normal luminance for a frame, and if a low voltage is applied to the bias voltage Vbias, impulsive driving is performed. Accordingly, by adjusting the bias voltage Vbias, mode conversion between impulsive driving and hole-type driving can be performed.

Figure 13:
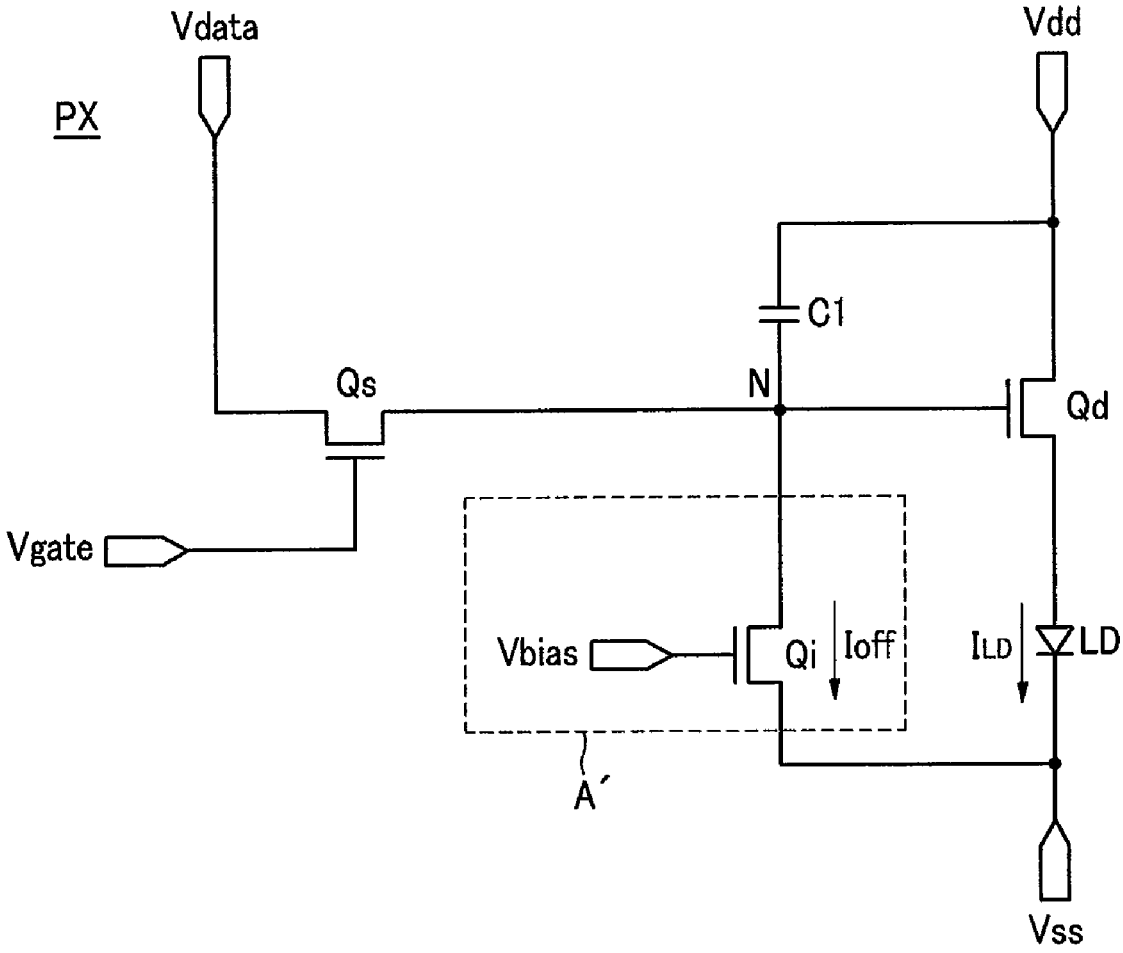

FIG. 13 illustrates a structure of the current leakage unit A' according to another exemplary embodiment of the present disclosure. The current leakage unit A' is connected between the contact point N and the common voltage Vss terminal, and includes the leakage transistor Qi. The control terminal of the leakage transistor Qi is connected to the bias voltage Vbias terminal, the input terminal thereof is connected to the contact point N, and the output terminal thereof is connected to the common voltage Vss terminal. Here, the bias voltage Vbias allows the leakage transistor Qi to not be turned on with a voltage value of a level that is formed by the leakage current Ioff through the leakage transistor Qi.

In an exemplary embodiment of FIG. 13, if a gate-on voltage Von is applied through the scanning signal line, a voltage VN of the contact point N rises and a current ILD flowing to the organic light emitting element LD also rises. Because the voltage VN of the contact point N is higher than a common voltage Vss, a leakage current Ioff flows from the contact point N to the common voltage Vss terminal through the leakage transistor Qi, and thus light emitting luminance decreases and black is finally displayed. That is, as in an exemplary embodiment of FIG. 2, impulsive driving can be performed.

Figure 14:
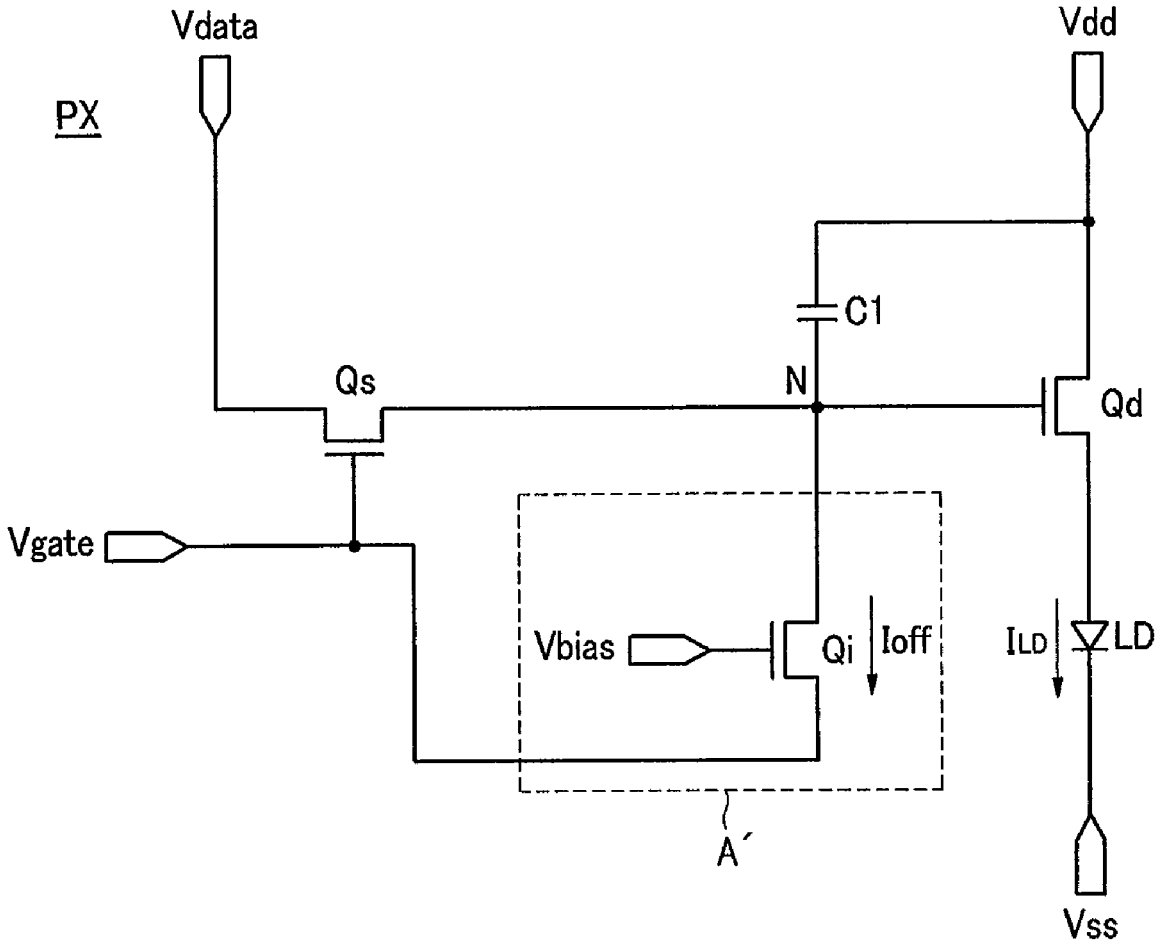

FIG. 14 illustrates a structure of a current leakage unit A' according to another exemplary embodiment of the present disclosure. Unlike the exemplary embodiment of FIG. 13, in an exemplary embodiment of FIG. 14, the output terminal of the leakage transistor Qi is connected to the scanning signal line. The current leakage unit A' is connected between the contact point N and the scanning signal line, and includes the leakage transistor Qi. The control terminal of the leakage transistor Qi is connected to the bias voltage Vbias terminal, the input terminal thereof is connected to the contact point N, and the output terminal thereof is connected to the scanning signal line. Here, the bias voltage Vbias allows the leakage transistor Qi to not be turned on with a voltage value of a level that is formed by a leakage current Ioff through the leakage transistor Qi.

Even in an exemplary embodiment of FIG. 14, if a gate-on voltage Von is applied through the scanning signal line, the voltage VN of the contact point N rises, and after the gate-on voltage Von is removed, because a gate voltage Vgate of the scanning signal line is lower than the voltage VN of the contact point N, the leakage current Ioff flows and thus impulsive driving can be performed. If the gate-on voltage Von is applied to the gate voltage Vgate and the gate-on voltage Von has a voltage value that is higher than the voltage VN of the contact point N, a current may flow from the output terminal toward the input terminal, and because a time period in which a gate-on voltage Von is applied is short for a time period of a frame, there is no problem in performing impulsive driving.

Figure 15:
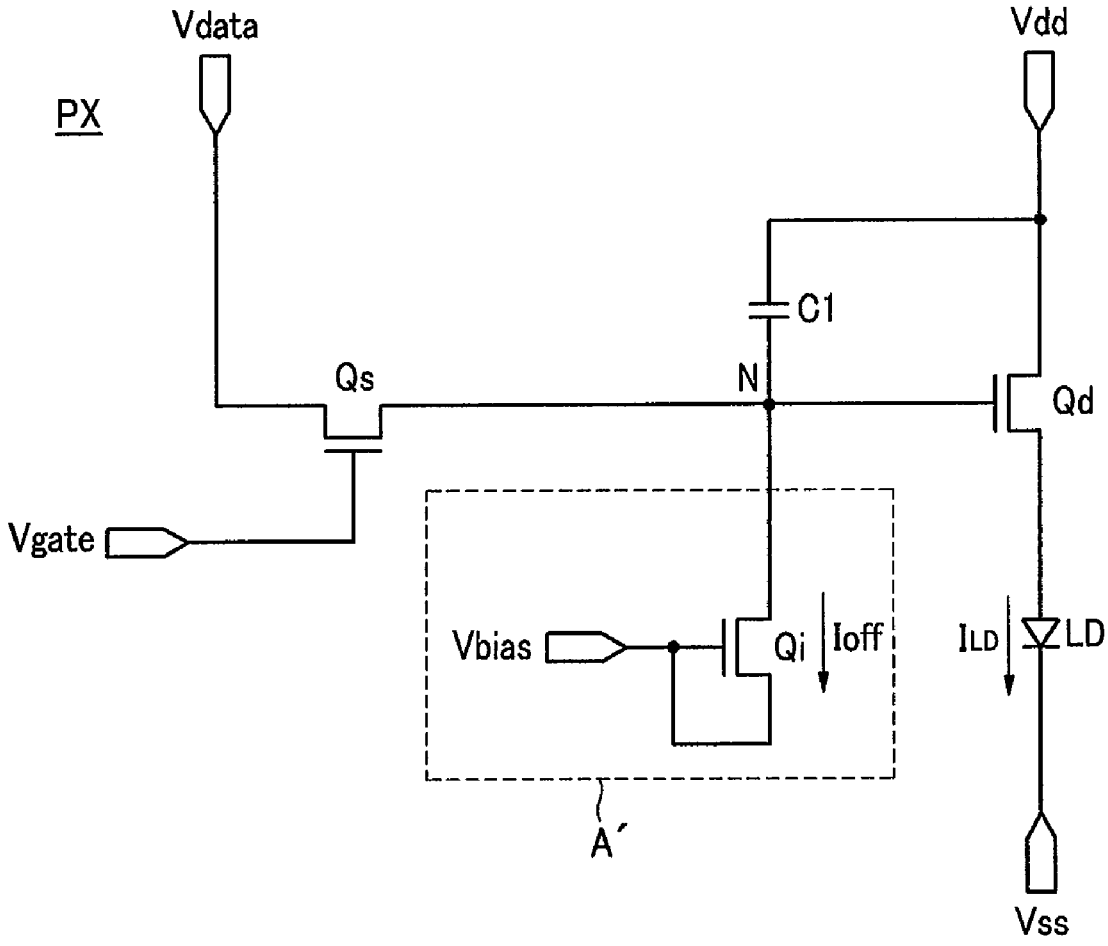

FIG. 14 illustrates a structure in which the output terminal of the leakage transistor Qi is connected to the scanning signal line of a pixel, however the output terminal of the leakage transistor Qi may be connected to a scanning signal line of a different pixel row. FIG. 15 illustrates a structure of the current leakage unit A' according to another exemplary embodiment of the present disclosure. Unlike the exemplary embodiment of FIG. 13, in an exemplary embodiment of FIG. 15, the output terminal of the leakage transistor Qi is connected to the bias voltage Vbias terminal.

In one embodiment, the current leakage unit A' is connected to the contact point N and includes a leakage transistor Qi. The control terminal and the output terminal of the leakage transistor Qi are connected to a bias voltage Vbias terminal, and the input terminal thereof is connected to the contact point N. Here, the bias voltage Vbias allows the leakage transistor Qi to not be turned on with a voltage value of a level that is formed by a leakage current Ioff through the leakage transistor Qi. Two voltages (a high voltage and a low voltage) are applied to the bias voltage Vbias, and the high voltage has a voltage value that is much higher than a voltage VN of the contact point N and the low voltage has a voltage value of a level that is formed by the leakage current Ioff. If the high voltage is applied to the bias voltage Vbias, the leakage current Ioff is not generated and light is emitted with identical luminance for a frame, and if a low voltage is applied to the bias voltage Vbias, impulsive driving can be performed. Accordingly, by adjusting the bias voltage Vbias, and mode conversion between impulsive driving and hole-type driving can be performed.

Figure 16:
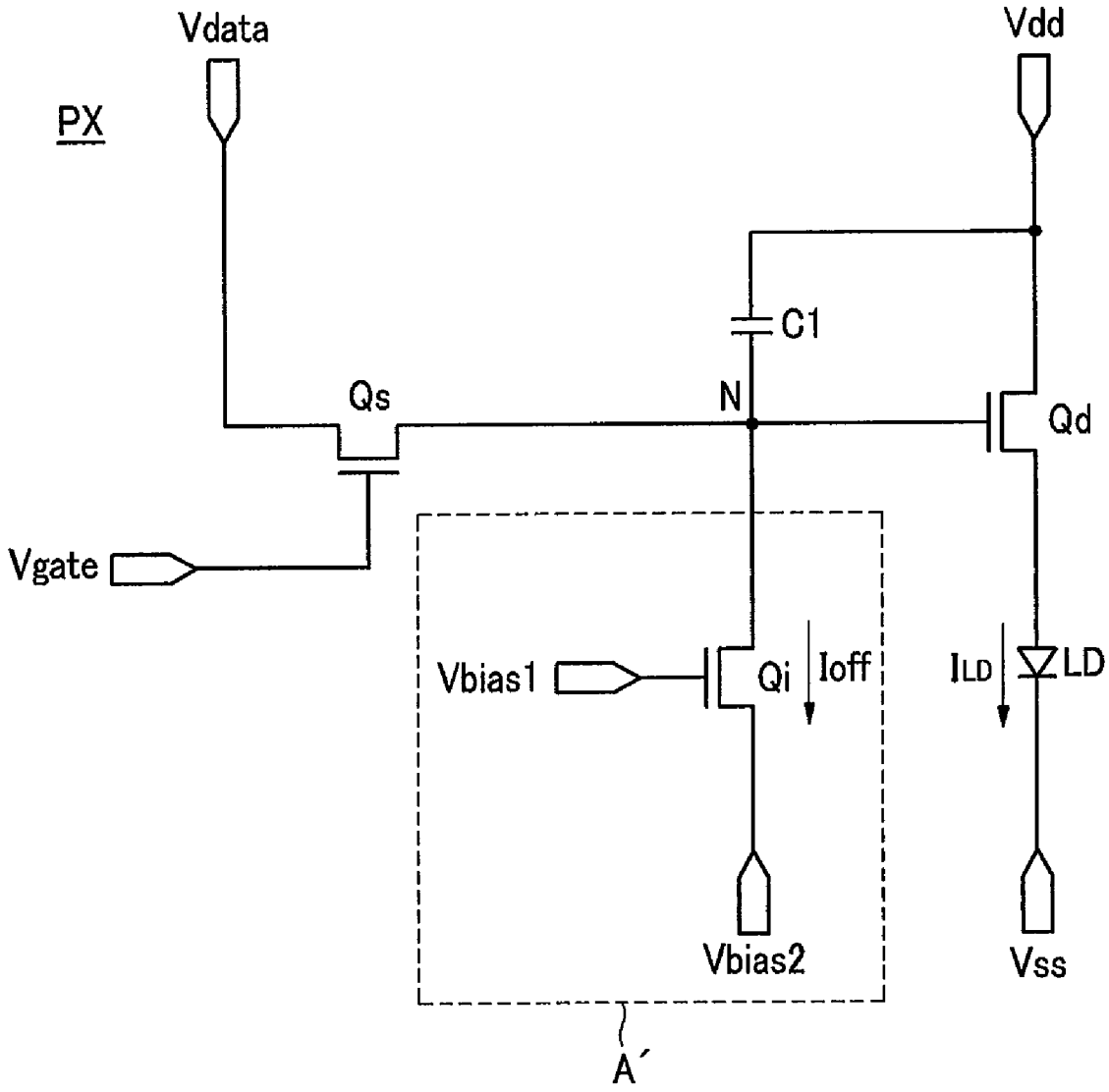

FIG. 16 illustrates a structure of a current leakage unit A' according to another exemplary embodiment of the present disclosure. Unlike the exemplary embodiment of FIG. 13, in an exemplary embodiment of FIG. 16, the output terminal of the leakage transistor Qi is connected to the bias voltage Vbias terminal, and unlike the exemplary embodiment of FIG. 15, a bias voltage Vbias1 that is connected to the control electrode of the leakage transistor Qi and a bias voltage Vbias2 that is connected to the output electrode are different terminals.

In one embodiment, the current leakage unit A' is connected to the contact point N and includes a leakage transistor Qi. The control terminal of the leakage transistor Qi is connected to a first bias voltage Vbias1 terminal, the input terminal thereof is connected to the contact point N, and the output terminal thereof is connected to a second bias voltage Vbias2. Here, the first bias voltage Vbias1 allows the leakage transistor Qi to not be turned on with a voltage value of a level that is formed by a leakage current Ioff through the leakage transistor Qi. The second bias voltage Vbias2 may allow continuous application of a voltage (low voltage) that is lower than a voltage VN of the contact point N and allow alternate application of two voltages (a high voltage and a low voltage). When application of a low voltage is continued, leakage of a leakage current Ioff is continued through the current leakage unit, so that impulsive driving can be performed.

In one embodiment, when two voltages (a high voltage and a low voltage) are alternately applied, when a high voltage is applied, a leakage current Ioff is not generated and thus light is emitted with normal luminance for a frame, and when a low voltage is applied, impulsive driving is performed. Accordingly, by adjusting the second bias voltage Vbias2, mode conversion between impulsive driving and hole-type driving can be performed. Here, the high voltage has a voltage value that is much higher than the voltage VN of the contact point N, and the low voltage has a voltage value of a level that is formed by the leakage current Ioff. In order to apply the bias voltage Vbias to the control terminal of the leakage transistor Qi of FIGS. 13 to 16, the control terminal of the leakage transistor Qi may be connected to a previous scanning signal line. When a gate-on voltage Von is applied to the previous scanning signal line, the leakage transistor Qi is turned on and thus the voltage VN of the contact point N is flowed out, whereby there is a merit that the pixel (particularly, the capacitor C1) is initialized.

In a top emission organic light emitting device, because common voltage Vss wiring is formed, the present disclosure can be easily executed, but in a bottom emission organic light emitting device, a common voltage Vss wiring may not be formed in a substrate. In the bottom emission organic light emitting device, it is preferable that the control terminal of the leakage transistor Qi is connected to the previous scanning signal line.

One or more embodiments of the present disclosure are characterized by including a current leakage unit in each pixel of the organic light emitting device. Accordingly, when having a basic pixel structure that is different from those of FIGS. 2 and 9 to 16, technology including the current leakage unit is included in a range of the present disclosure.

While the present disclosure has been described in connection with what is presently considered to be one or more practical exemplary embodiments, it is to be understood that the present disclosure is not limited to the disclosed embodiments, but is intended to cover various modifications and equivalent arrangements included within the spirit and scope of the appended claims.

What is claimed is:

1. A display device comprising:

a light-emitting device;

a driving transistor connected to a driving voltage, the driving transistor to supply a current to the light-emitting device;

a switching transistor connected to the driving transistor, the switching transistor to selectively transfer a data voltage; and a current leakage unit adapted to decrease an amount of current supplied to the light-emitting device through the driving transistor, wherein each of the driving transistor and the switching transistor comprises a control terminal, an input terminal, and an output terminal, and wherein a contact point is disposed between the control terminal of the driving transistor and the output terminal of the switching transistor, and wherein the current leakage unit is connected through the contact point.

2. The display device of claim 1, wherein the current leakage unit decreases an amount of current supplied to the light-emitting device within one frame.

3. The display device of claim 2, wherein the light-emitting device displays black luminance while displaying normal luminance within the one frame.

4. The display device of claim 1, wherein the current leakage unit comprises a leakage transistor comprising a control terminal, an input terminal, and an output terminal, and wherein the input terminal of the leakage transistor is connected to the contact point, and wherein the control terminal of the leakage transistor is connected to the input terminal thereof.

5. The display device of claim 4, wherein one end of the light-emitting device is connected to the output terminal of the driving transistor, and the other end thereof is connected to a common voltage terminal, and wherein the output terminal of the leakage transistor is connected to the common voltage terminal.

6. The display device of claim 4, wherein the control terminal of the switching transistor is connected to a scanning signal line, and wherein the output terminal of the leakage transistor is connected to the scanning signal line.

7. The display device of claim 4, wherein the control terminal of the switching transistor is connected to a first scanning signal line, and wherein the output terminal of the leakage transistor is connected to a second scanning signal line.

8. The display device of claim 4, wherein the output terminal of the leakage transistor is connected to a bias voltage.

9. The display device of claim 8, wherein the bias voltage has at least a first voltage level and a second voltage level, and wherein, if the first voltage level is applied to the bias voltage, a current is not leaked through the current leakage unit, and wherein, if the second voltage level is applied to the bias voltage, a current is leaked through the current leakage unit.

10. The display device of claim 1, wherein the current leakage unit comprises a leakage transistor comprising a control terminal, an input terminal, and an output terminal, and wherein the input terminal of the leakage transistor is connected to the contact point, and wherein the control terminal of the leakage transistor is connected to the output terminal thereof.

11. The display device of claim 1, wherein the current leakage unit comprises a leakage transistor comprising a control terminal, an input terminal, and an output terminal, and wherein the input terminal of the leakage transistor is connected to the contact point, and the control terminal of the leakage transistor is connected to a first bias voltage.

12. The display device of claim 11, wherein one end of the light-emitting device is connected to the output terminal of the driving transistor, and the other end thereof is connected to a common voltage terminal, and wherein the output terminal of the leakage transistor is connected to the common voltage terminal.

13. The display device of claim 11, wherein the control terminal of the switching transistor is connected to a scanning signal line, and wherein the output terminal of the leakage transistor is connected to the scanning signal line.

14. The display device of claim 11, wherein the control terminal of the switching transistor is connected to a first scanning signal line, and wherein the output terminal of the leakage transistor is connected to a second scanning signal line.

15. The display device of claim 11, wherein the output terminal of the leakage transistor is connected to the first bias voltage.

16. The display device of claim 11, wherein the output terminal of the leakage transistor is connected to a second bias voltage.

17. The display device of claim 16, wherein the second bias voltage has at least a first voltage level and a second voltage level, and wherein, if the first voltage level is applied to the bias voltage, a current is not leaked through the current leakage unit, and wherein, if the second voltage level is applied to the bias voltage, a current is leaked through the current leakage unit.

18. The display device of claim 11, wherein the first bias voltage is applied from a different scanning signal line from a scanning signal line to which the switching transistor is connected.

19. The display device of claim 1, further comprising a capacitor that is connected between the input terminal of the driving transistor and the contact point.

20. A method of driving a display device comprising a plurality of pixels comprising a light-emitting device, a driving transistor that supplies a current to the light-emitting device, and a current leakage unit, the method comprising:

allowing the light-emitting device to emit light by applying a data signal to the driving transistor; and decreasing an amount of a current flowing to the light-emitting device through the current leakage unit that is directly connected to the driving transistor and the switching transistor, and which has three terminals.

21. The method of claim 20, wherein the decreasing of an amount of a current flowing to the light-emitting device through the current leakage unit comprises:

selectively performing one of decreasing an amount of a current flowing to the light-emitting device by applying a first voltage to the current leakage unit and not decreasing an amount of a current flowing to the light-emitting device by applying a second voltage to the current leakage unit.

22. The method of claim 20, wherein the pixel displays black after a predetermined time period has elapsed as an amount of a current flowing to the light-emitting device decreases.

* * * * *